US006715251B2

(12) United States Patent
Yang

(10) Patent No.: US 6,715,251 B2
(45) Date of Patent: Apr. 6, 2004

(54) DECORATIVE SIMULATED THATCH UNIT

(76) Inventor: Han-Lung Yang, No. 48-1, Tien Chung Chuang, Tien Chung Lee, Chang Hua City (TW)

( * ) Notice: Subject to any disclaimer, the term of this patent is extended or adjusted under 35 U.S.C. 154(b) by 0 days.

(21) Appl. No.: 10/246,120

(22) Filed: Sep. 17, 2002

(65) Prior Publication Data

US 2003/0188502 A1 Oct. 9, 2003

(51) Int. Cl.[7] ..... E04D 9/00

(52) U.S. Cl. ..... 52/555; 52/518; 52/750; 428/17; 428/27

(58) Field of Search ..... 52/535, 518, 750; 428/17, 27; 151/171, 173, 177, 178

(56) References Cited

U.S. PATENT DOCUMENTS

| | | | | |
|---|---|---|---|---|
| 233,269 | A | * | 10/1880 | McClelland |
| 614,478 | A | * | 11/1898 | Johnston |
| 704,483 | A | * | 7/1902 | Mansfield |
| 1,131,012 | A | * | 3/1915 | Speese |
| 1,492,610 | A | * | 5/1924 | Simpson |
| 1,644,799 | A | * | 10/1927 | Toplitz |
| 4,611,451 | A | * | 9/1986 | Symbold |
| 6,226,949 | B1 | * | 5/2001 | Huber |
| 6,470,642 | B1 | * | 10/2002 | Eads |

FOREIGN PATENT DOCUMENTS

| | | | | |
|---|---|---|---|---|
| GB | 1220871 | * | 1/1971 | |
| GB | 2238591 | * | 6/1991 | ..... F16B/15/00 |
| GB | 2279974 | * | 1/1995 | ..... E04D/9/00 |
| JP | 6-57892 | * | 3/1994 | ..... E04D/9/00 |

* cited by examiner

*Primary Examiner*—Robert Canfield
(74) *Attorney, Agent, or Firm*—Ostrolenk, Faber, Gerb & Soffen, LLP

(57) ABSTRACT

A decorative simulated thatch unit includes a clamp, flexible decorative cords, and a press strip. The clamp includes a top wall, two side walls confronting each other, and spaced teeth provided longitudinally along at least one of the side walls and distally from the top wall, and extending toward the other one of the side walls. The top wall cooperates with the side walls to define a receiving space. The decorative cords have U bent portions received in the receiving space and clamped by the side walls, and two end portions extending out of the clamp from the U bent portions through gaps among the teeth. The press strip is received in and is straddled by the U bent portions. The press strip presses the U bent portions against the top wall, and is retained in the receiving space by the teeth.

3 Claims, 7 Drawing Sheets

DECORATIVE SIMULATED THATCH UNIT

BACKGROUND OF THE INVENTION

1. Field of the Invention

The invention relates to a decorative simulated thatch unit, more particularly to a decorative simulated thatch unit capable of being produced in a relatively simple manner.

2. Description of the Related Art

Referring to FIGS. 1 and 2, a conventional decorative simulated thatch unit 1 is shown to be nailed onto a roof 4 covered with a waterproofing plastic film 5 so as to decorate the roof 4. The decorative simulated thatch unit 1 includes a clamp 2 and a plurality of decorative cords 3 made of flexible plastic. The clamp 2 includes a top wall 201, two side walls 202 extending from opposite longitudinal edges of the top wall 201 and confronting each other, and a plurality of confining units 203 provided longitudinally along both of the side walls 202 and distally from the top wall 201. The confining units 203 are spaced apart equally from each, and the confining units 203 on one of the side walls are staggered relative to the confining units 203 on the other one of the side walls 202. The top wall 201 cooperates with the side walls 202 and the confining units 203 to define a receiving space 204. Each of the confining units 203 has a U bent end portion 2031, which cooperates with the top wall 201 to confine the decorative cords 3 within the receiving space 204.

The conventional decorative simulated thatch unit 1 suffers from the following shortcomings:

1. Since the confining units 203 should be processed into a U shape before bending the clamp 2 to form the receiving space 204, the manufacturing process is relatively complicated.
2. When the gap between two adjacent staggered confining units 203 is too large, some of the decorative cords 3 cannot be properly confined by the staggered confining units 203. On the other hand, when the aforesaid gap is too small, some of the decorative cords 3 may be destroyed by the confining units 203.
3. Since each of the confining units 203 has a certain width, the decorative cords 3 may be confined unevenly.

SUMMARY OF THE INVENTION

Therefore, the object of the present invention is to provide a decorative simulated thatch unit which can be produced in a relatively simple manner and which is capable of overcoming the aforesaid drawbacks of the prior art.

The decorative simulated thatch unit according to this invention includes a clamp, a plurality of flexible decorative cords, and a press strip. The clamp includes a top wall having two opposite longitudinal edges, two side walls extending from the opposite longitudinal edges respectively and confronting each other, and a plurality of spaced teeth provided longitudinally along at least one of the side walls and distally from the top wall, and extending toward the other one of the side walls. The top wall cooperates with the side walls to define a receiving space. The flexible decorative cords have U bent portions received in the receiving space and clamped by the side walls, and two end portions extending out of the clamp from the U bent portions through gaps among the teeth. The press strip is received in and is straddled by the U bent portions. The press strip presses the U bent portions against the top wall, and is retained in the receiving space by the teeth.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
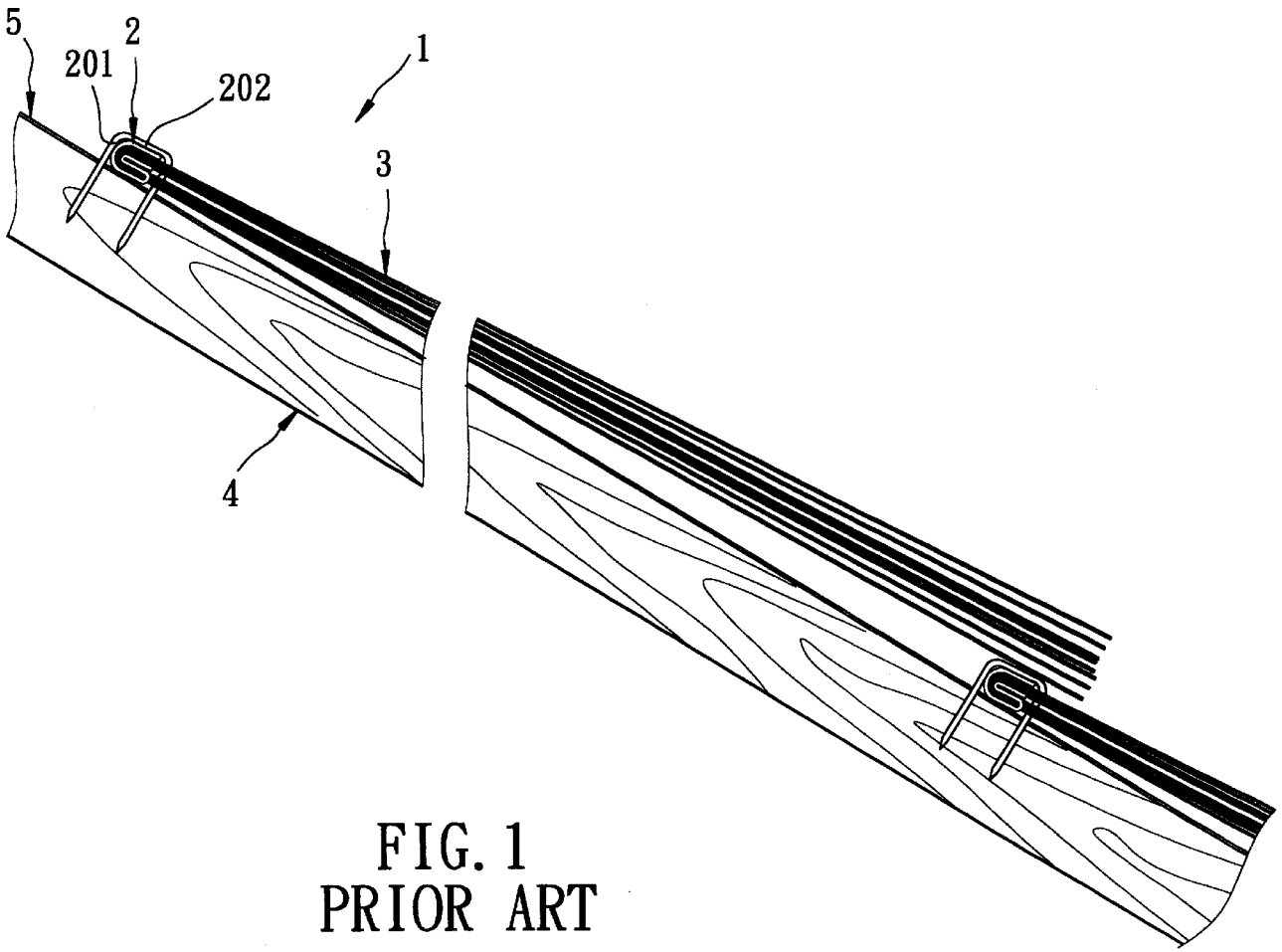
FIG. 1 PRIOR ART
FIG. 1 is a fragmentary schematic view of a conventional decorative simulated thatch unit.
Figure 2:
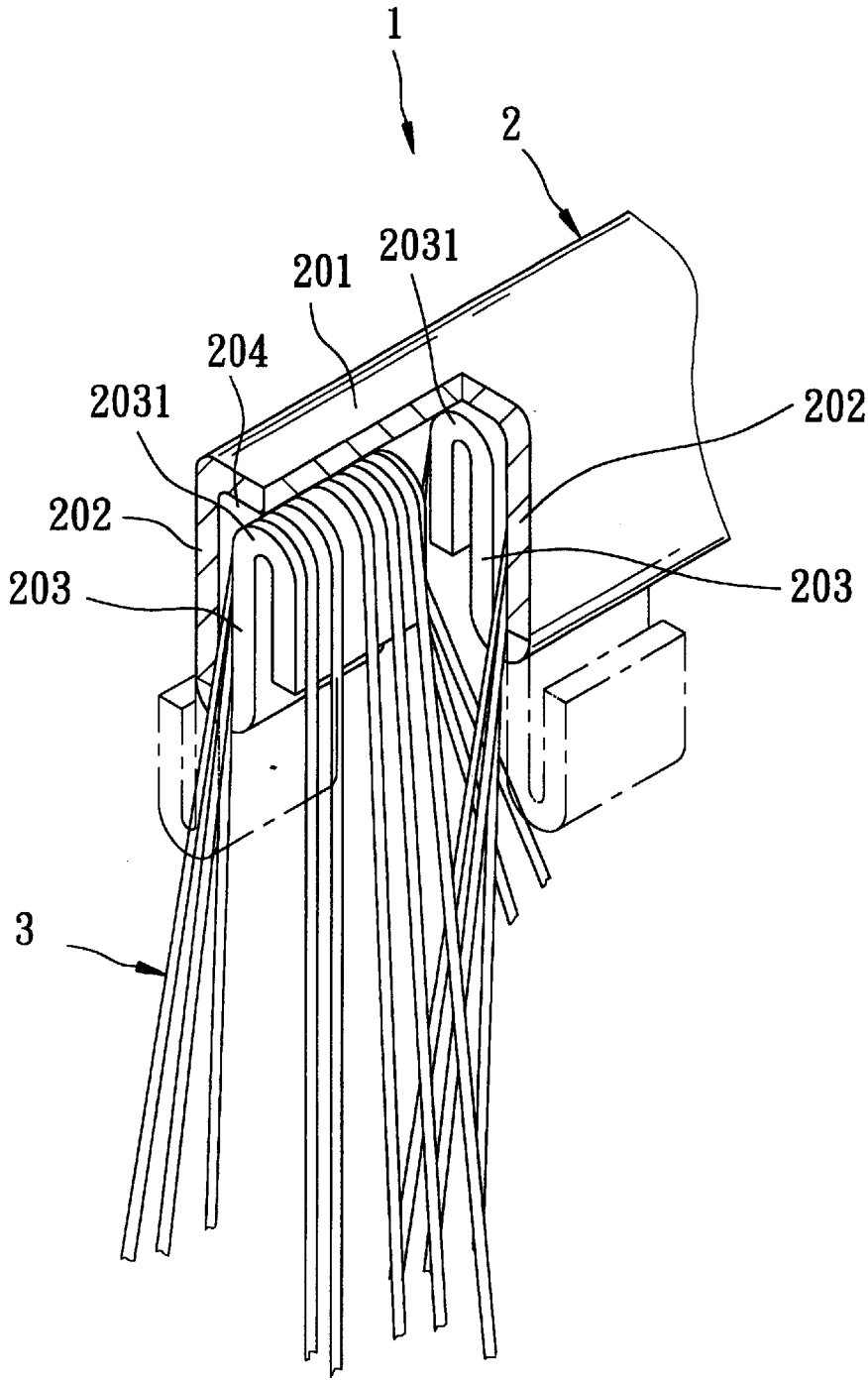
FIG. 2 PRIOR ART
FIG. 2 is a fragmentary perspective partly-sectional view of the conventional decorative simulated thatch unit.
Figure 3:
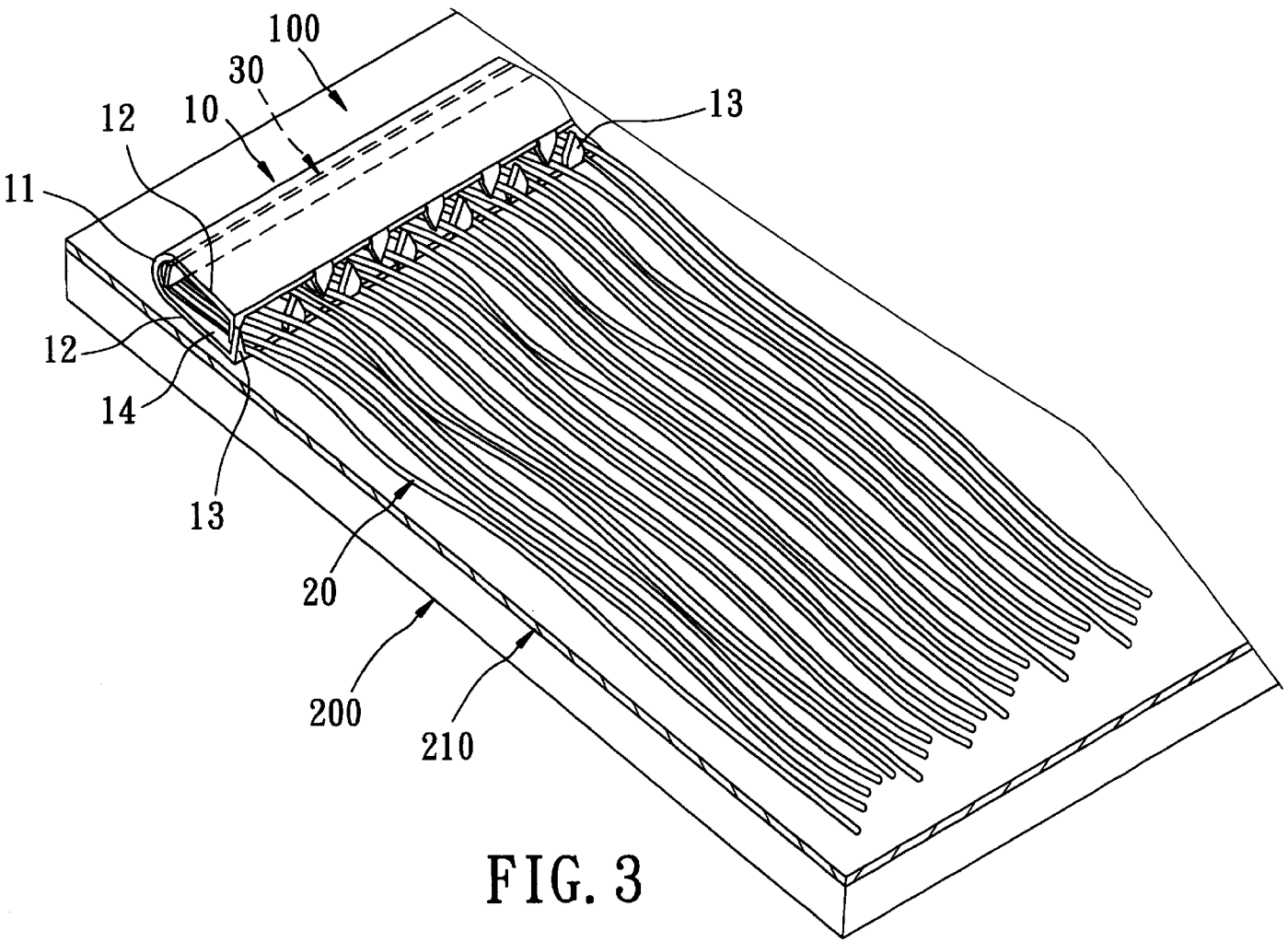
FIG. 3 is a fragmentary perspective view of the preferred embodiment of a decorative simulated thatch unit according to this invention.
Figure 4:
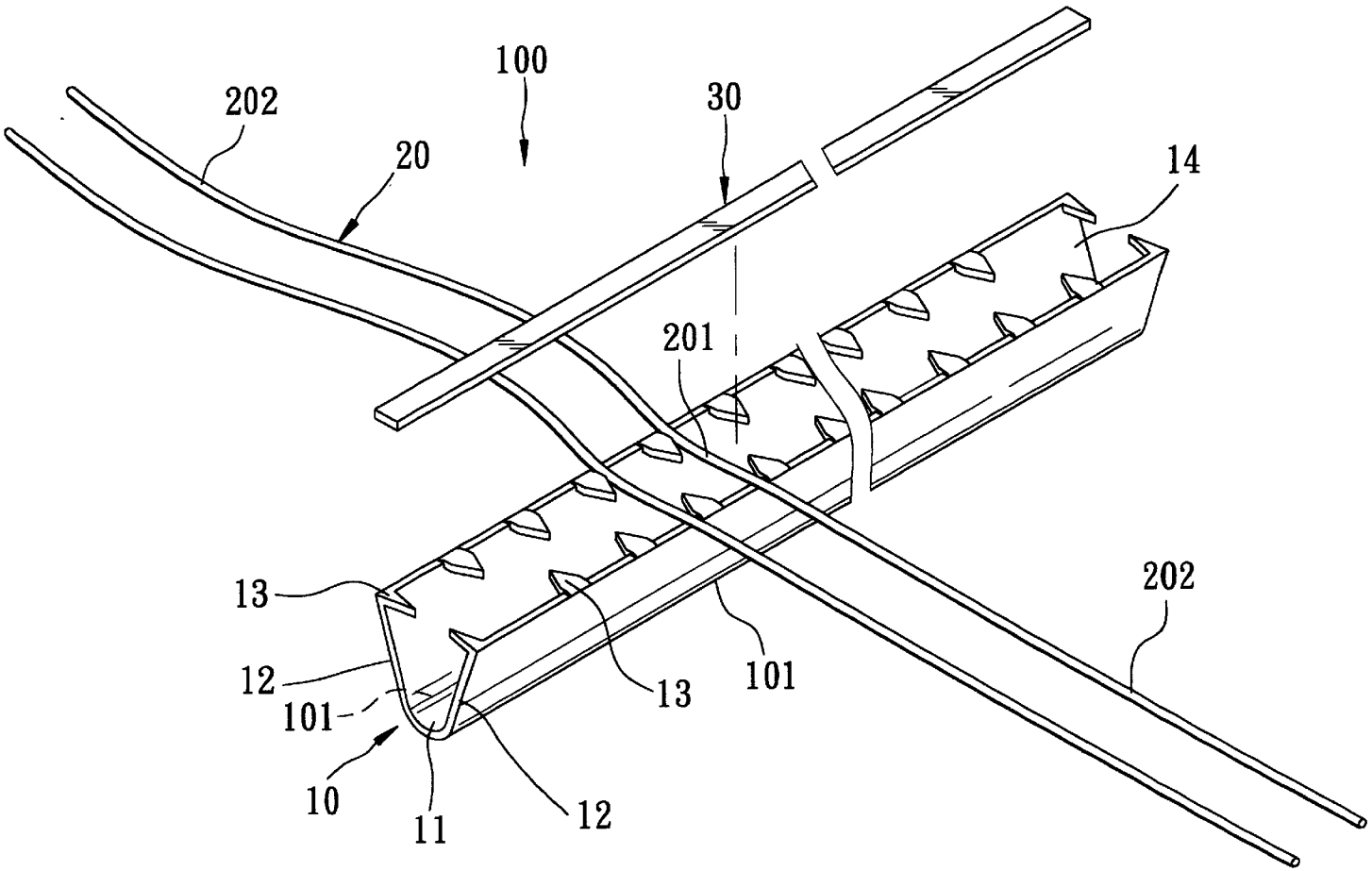
FIG. 4 is an exploded perspective view of the preferred embodiment.

Referring to FIGS. 3 and 4, the decorative simulated thatch unit 100 according to the preferred embodiment of this invention is adapted to be mounted on a roof 200 covered with a waterproofing plastic film 210. The decorative simulated thatch unit 100 can be fixed onto the roof 200 by any appropriate method, such as by nailing. The decorative simulated thatch unit 100 is shown to include a clamp 10, a plurality of flexible decorative cords 20, and a press strip 30.

The clamp 10 includes a top wall 11 having two opposite longitudinal edges 101, two side walls 12 extending from the opposite longitudinal edges 101 respectively and confronting each other, and a plurality of spaced teeth 13 provided longitudinally along at least one of the side walls 12 and distally from the top wall 11, and extending toward the other one of the side walls 12. In this embodiment, the teeth 13 of the clamp 10 are provided longitudinally on both of the side walls 12. Moreover, the teeth 13 on one of the side walls 12 are staggered relative to the teeth 13 on the other one of the side walls 12. The teeth 13 on the side walls 12 are also spaced apart equally from each other. The top wall 11 cooperates with the side walls 12 to define a receiving space 14.

The flexible decorative cords 20 have U bent portions 201 received in the receiving space 14 and clamped by the side walls 12, and two end portions 202 extending out of the clamp 10 from the U bent portions 201 through gaps among the teeth 13. Each of the flexible decorative cords 20 is made of plastic and has an appearance that simulates a strand of thatch.

The press strip 30 is received in and is straddled by the U bent portions 201. The press strip 30 presses the U bent portions 201 against the top wall 11, and is retained in the receiving space 14 by the teeth 13.

Figure 5:
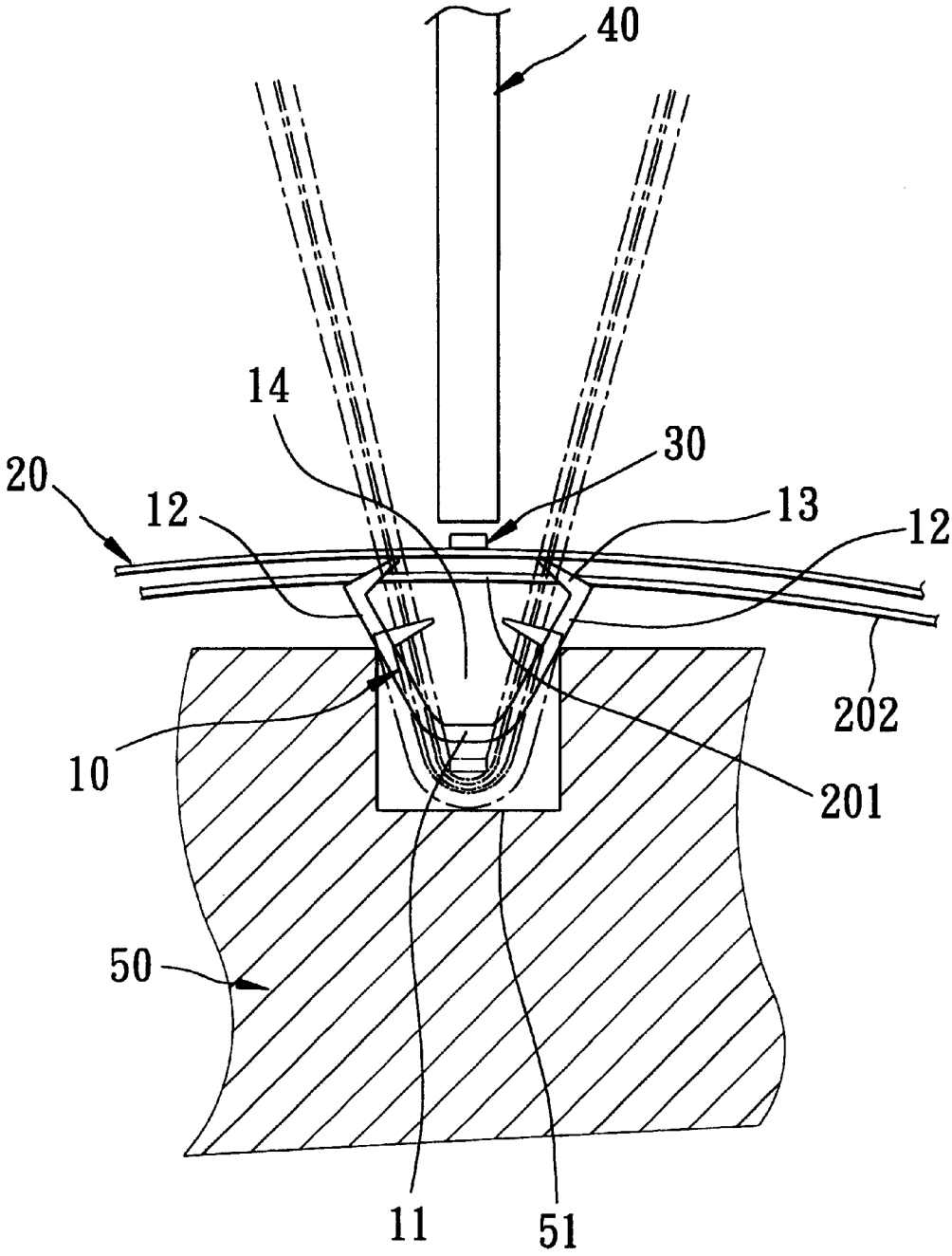
FIGS. 5 to 7 illustrate consecutive steps for making the preferred embodiment of the decorative simulated thatch unit according to this invention.

Referring to FIG. 5, during the manufacture of the decorative simulated thatch unit 100 according to the preferred embodiment of this invention, the clamp 10 is first placed in a forming groove 51 of a mold 50. The decorative cords 20 are then evenly arranged on the side walls 12 of the clamp 10, and the press strip 30 is provided longitudinally on the decorative cords 20. At this time, the press strip 30 can be punched by a puncher 40 so as to force the press strip 30 and the U bent portions 201 of the decorative cords 20 into the receiving space 14 of the clamp 10 and so that the end portions 202 of the decorative cords 20 extend out of the clamp 10 from the U bent portions 201 of the decorative cords 20 through the gaps among the staggered teeth 13. At the same time, the side walls 12 of the clamp 10 are deformed to move toward each other, and to preliminarily confine the press strip 30 and the U bent portions 201 of the decorative cords 20 within the receiving space 14 of the clamp 10.

Figure 6:
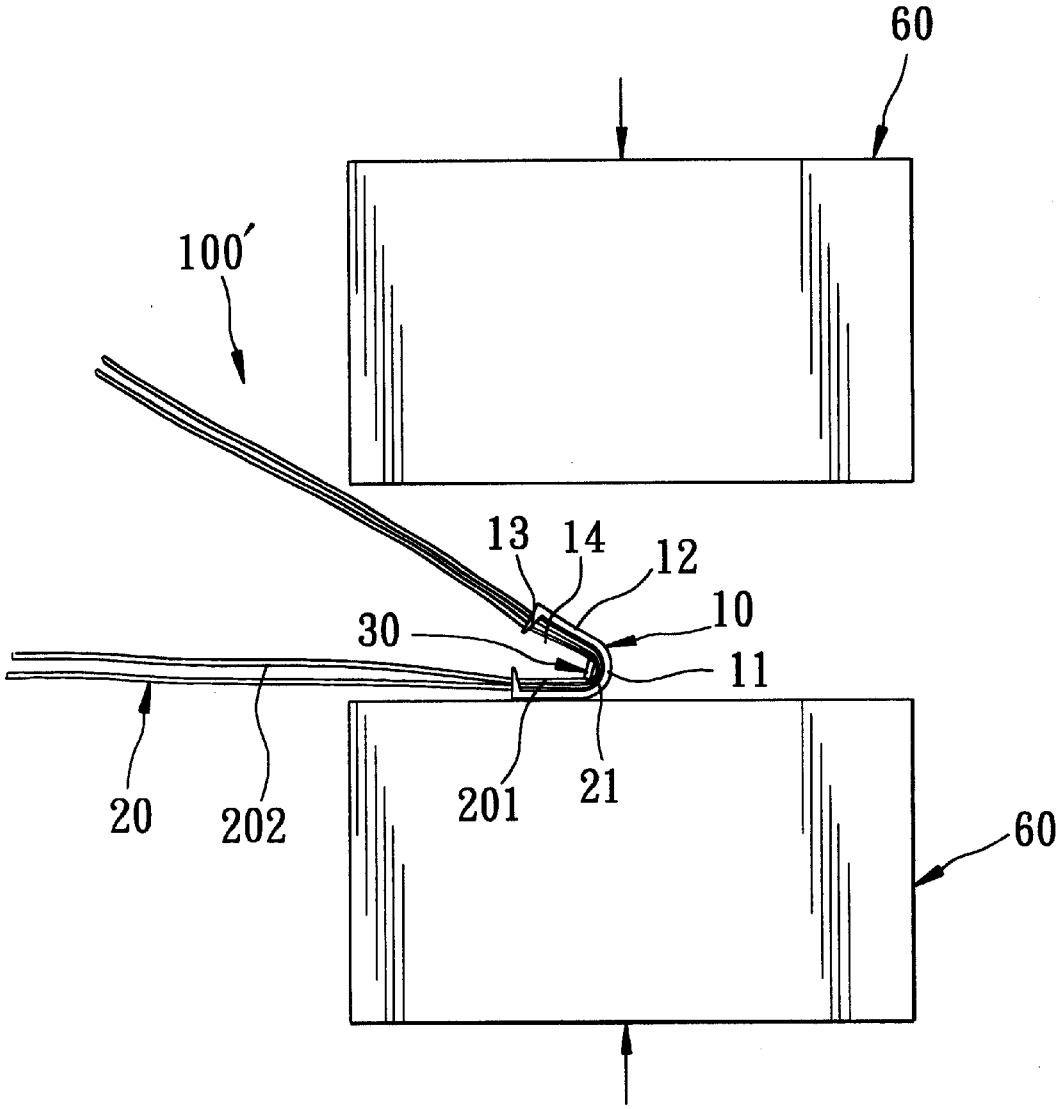
Figure 7:
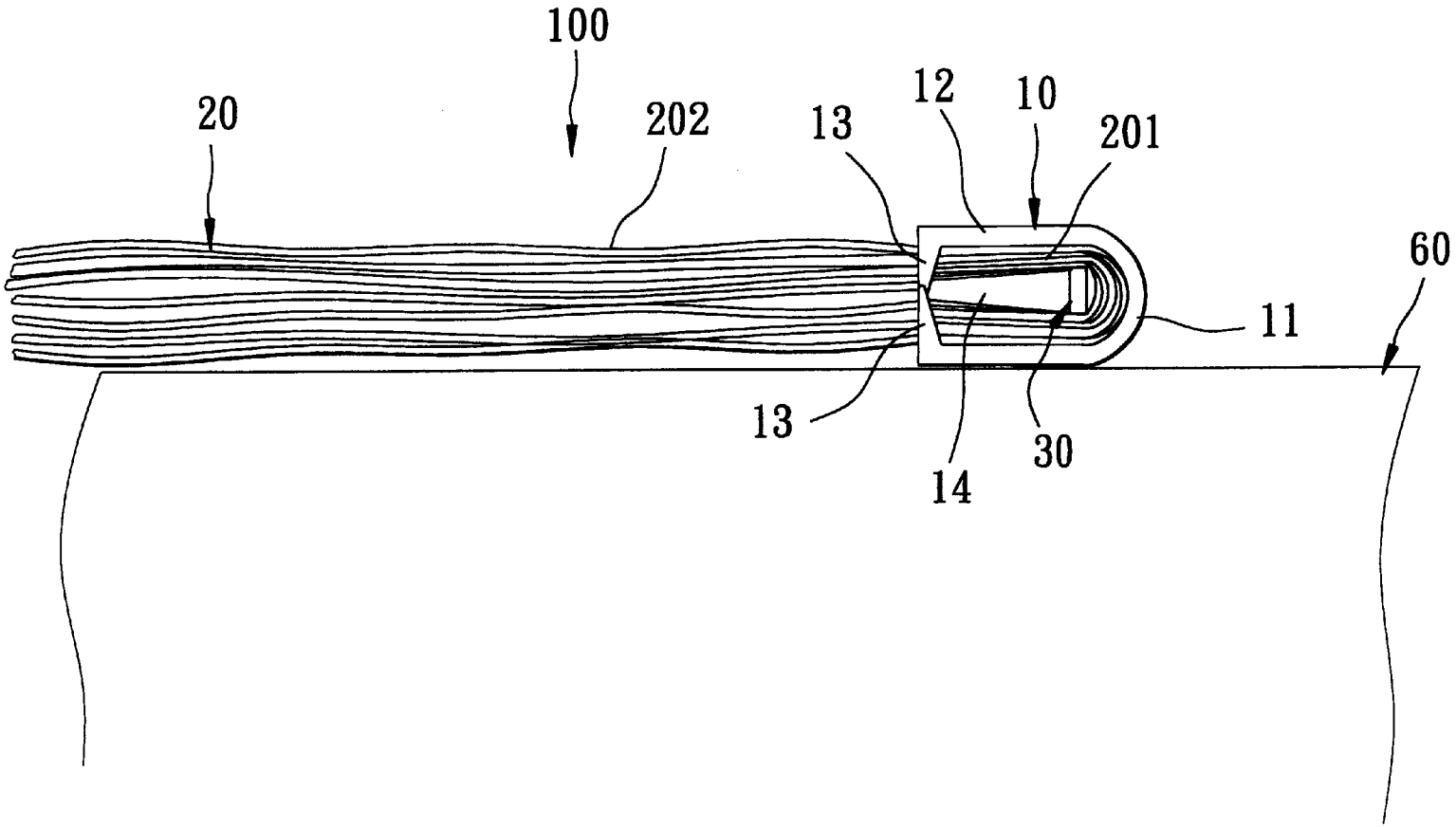

Referring to FIG. 6, the simulated thatch unit 100' obtained from the processing step shown in FIG. 5 is then disposed between two pressing molds 60. The side walls 12 of the clamp 10 are further pressed by the pressing molds 60 so as to further restrict the press strip 30 and the U bent portions 201 of the decorative cords 20 within the receiving space 14 of the clamp 10, thereby resulting in the decorative simulated thatch unit 100 shown in FIG. 7.

The following are some of the advantages of the decorative simulated thatch unit according to this invention:

(1) The decorative simulated thatch unit according to this invention can be produced in a relatively simple manner.

(2) The decorative cords 20 can be properly and evenly confined by the teeth 13 of the clamp 10. The destruction of the decorative cords 20 as commonly encountered in the prior art can also be avoided.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A decorative simulated thatch unit, comprising:

a clamp including a top wall having two opposite longitudinal edges, two side walls extending from the longitudinal edges respectively and confronting each other, each of the side walls including a distal end, and a plurality of spaced teeth arranged on the distal end of each of the side walls, the spaced teeth of the two side walls extending toward one another and being staggered with respect to one another so that each of the spaced teeth of the distal end of one of the side walls extends between two adjacent spaced teeth of the distal end of the other one of the side walls, the top wall and the two side walls defining a receiving space;

a plurality of flexible decorative cords, each cord having a U-shaped bent portion and two end portions, the U-shaped bent portions of the cords being arranged within the receiving space, the two end portions of each cord extending out of the clamp between the spaced teeth, the side walls of the clamp clamping the cords; and a press strip arranged entirely within the receiving space behind the spaced teeth, the press strip being straddled by the U-shaped bent portions of the flexible decorative cords, the press strip pressing the U-shaped bent portions of the cords against the top wall of the clamp, the spaced teeth retaining the press strip within the receiving space.

2. The decorative simulated thatch unit of claim 1, wherein the spaced teeth of the side walls are spaced apart equally from one another.

3. The decorative simulated thatch unit of claim 1, wherein each of the flexible decorative cords is made of plastic and has an appearance that simulates a strand of thatch.

* * * * *